US005571346A

United States Patent [19]

Bergsma

[11] Patent Number: 5,571,346

[45] Date of Patent: Nov. 5, 1996

[54] CASTING, THERMAL TRANSFORMING AND SEMI-SOLID FORMING ALUMINUM ALLOYS

[75] Inventor: S. Craig Bergsma, The Dalles, Oreg.

[73] Assignee: Northwest Aluminum Company, The Dalles, Oreg.

[21] Appl. No.: 422,242

[22] Filed: Apr. 14, 1995

[51] Int. Cl.[6] ..... C22F 1/04

[52] U.S. Cl. ..... 148/550; 148/552

[58] Field of Search ..... 148/549, 550, 148/552, 688, 690, 689, 695, 698

[56] References Cited

U.S. PATENT DOCUMENTS

| | | |
|---|---|---|
| 3,902,544 | 9/1975 | Flemings et al. . |
| 3,936,298 | 2/1976 | Mehrabian et al. . |
| 3,948,650 | 4/1976 | Flemings et al. . |
| 3,988,180 | 10/1976 | Bouvaist . |
| 4,106,956 | 8/1978 | Bercovici . |
| 4,108,643 | 8/1978 | Flemings et al. . |
| 4,116,423 | 9/1978 | Bennett . |
| 4,415,374 | 11/1983 | Young et al. . |
| 4,434,839 | 3/1984 | Vogel . |
| 4,450,893 | 5/1984 | Winter et al. . |
| 4,482,012 | 11/1984 | Young et al. . |
| 4,510,987 | 4/1985 | Collot . |
| 4,524,820 | 6/1985 | Gullotti et al. . |
| 4,565,241 | 1/1986 | Young . |
| 4,569,218 | 2/1986 | Baker et al. . |
| 4,569,702 | 2/1986 | Ashok et al. . |
| 4,572,818 | 2/1986 | Flemings . |
| 4,585,494 | 4/1986 | Ashok et al. . |
| 4,594,117 | 6/1986 | Pryor et al. . |
| 4,598,763 | 7/1986 | Wagstaff et al. . |
| 4,642,146 | 2/1987 | Ashok et al. . |
| 4,687,042 | 8/1987 | Young . |
| 4,693,298 | 9/1987 | Wagstaff . |
| 4,694,882 | 9/1987 | Busk . |
| 4,709,746 | 12/1987 | Young et al. . |
| 4,771,818 | 9/1988 | Kenney . |
| 4,804,034 | 2/1989 | Leatham et al. . |
| 4,865,808 | 9/1989 | Ichikawa et al. . |
| 4,926,924 | 5/1990 | Brooks et al. . |
| 4,964,455 | 10/1990 | Meyer . |
| 5,009,844 | 4/1991 | Laxmanan . |
| 5,106,062 | 4/1992 | Sergio . |
| 5,161,601 | 11/1992 | Abis et al. . |
| 5,186,236 | 2/1993 | Gabathuler et al. . |

FOREIGN PATENT DOCUMENTS

| | | |
|---|---|---|
| 2266749 | 10/1975 | France . |
| 59-50147 | 3/1984 | Japan . |
| 60-155655 | 8/1985 | Japan . |
| 1400624 | 7/1975 | United Kingdom . |
| 1444274 | 7/1976 | United Kingdom . |
| 1543206 | 3/1979 | United Kingdom . |
| 9213662 | of 1992 | WIPO . |

OTHER PUBLICATIONS

Wan et al, "Thixoforming of Aluminum Alloys Using Modified Chemical Grain Refinement for Billet Production", Int. Conf. Aluminum Alloys: New Process Technologies, Marina di Ravenna, Italien, 3.–4, Jun 1993, pp. 129–141.

Hirt et al, "SSM–Forming of Usually Wrought Aluminum Alloys", The 3rd Int'l. Conf. on Semi–Solid Processing of Alloys and Composites 1994.6, pp. 107–116.

*Primary Examiner*—Deborah Yee

*Attorney, Agent, or Firm*—Andrew Alexander

[57] ABSTRACT

A process for casting, thermally transforming and semi-solid forming an aluminum base alloy into an article, the process comprising the steps of: casting a molten body of aluminum base alloy to provide a solidified body, the molten aluminum base alloy being solidified at a rate between liquidus and solidus temperatures of the aluminum base alloy in a range of 5° to 100° C./sec. to provide an entire solidified body having a denditic microstructure. Thereafter, heat is applied to the solidified body to bring the body to a superheated temperature of 3° to 50° C. above the solidus temperature of the aluminum base alloy while maintaining a body in a solid shape and effecting thermal transformation of the body having the dendritic structure when the entire body is uniformly heated to the superheated temperature. The body having a non-dendritic structure is formed in a semi-solid condition into the article.

58 Claims, 7 Drawing Sheets

SCHEMATIC PLOT OF FREE ENERGY BARRIER TO NUCLEATION AT CONSTANT TEMPERATURE

SCHEMATIC ILLUSTRATION OF THE MELTING PROCESS NEAR A SILICON PARTICLE

CASTING, THERMAL TRANSFORMING AND SEMI-SOLID FORMING ALUMINUM ALLOYS

BACKGROUND OF THE INVENTION

This invention relates to semi-solid aluminum alloys, and more particularly, it relates to a method of casting and thermally transforming bodies of aluminum alloys from a dendritic structure to a non-dendritic structure and forming the thermally transformed bodies.

Most aluminum alloys solidify to form a dendritic microstructure. A solid alloy having a dendritic microstructure is difficult to form as, for example, in extruding or forging operations. It is well known that microstructures obtained when the alloy is heated to the solidus temperature are more susceptible to such forming practices. That is, when the body is heated, a transformation is obtained from a dendritic microstructure to a globular or spherical phase contained in a lower melting eutectic matrix. After rapid cooling, the alloy retains the globular or spheroidal phase. If the body is reheated to between liquidus and solidus temperature, the transformed phase is retained. Thus, the alloy is provided in a thixotropic state which provides for ease of forming or casting because the metal can be forced into a mold utilizing smaller forces than normally required for the solidified form. Another advantage of using semi-solid metal for casting is a decrease in shrinkage of the formed part on solidification.

However, transforming the alloys from the dendritic microstructure to spheroidal or globular phase retained in the lower melting eutectic matrix is not without problems. For example, U.S. Pat. No. 5,009,844 discloses a semi-solid metal-forming of hypoeutectic aluminum-silicon alloys without formation of elemental silicon. The process comprises heating a solid billet of the alloy to a temperature between the liquidus temperature and the solidus temperature at a rate not greater than 30° C. per minute, preferably not greater than 20° C. per minute, to form a semi-solid body of the alloy while inhibiting the formation of free silicon particles therein. The semi-solid body comprises a primary spheroidal phase dispersed in a eutectic-derived liquid phase and is conducive to forming at low pressure. According to the patent, a billet having a quiescently cast microstructure characterized by primary dendrite particles in a eutectic matrix is heated at the slow rate and maintained at the intermediate temperature for a time sufficient to transform the dendrite phase into the desired spheroidal phase. However, slow heat-up rates can lead to microporosity and inferior properties. According to this patent, rapid heat-up rates of hypoeutectic aluminum-silicon alloys to the semi-solid condition are detrimental and produce the free silicon particles.

U.S. Pat. No. 4, 106,956 discloses a process for facilitating extrusion or rolling of a solidified dendritic aluminum base alloy billet, or the like, by heating the billet to provide an inner liquid phase of below 25%, by weight, wherein the dendritic phase has started to develop into a primary solid globular phase without disturbing the solidified character of the billet, followed by working of the treated billet. The process enables a reduction in working pressure and results in improved mechanical properties of the product. Optionally, in the case of precipitation hardening aluminum base alloys, quenching of the workpiece is effected as it exits from the die or mill, followed by artificial or natural aging. In another embodiment, the composition of the alloy of the billet being treated contains an amount of hardening constituent whereby the composition of the globular solid phase of the product approximates the composition of the alloy per se.

U.S. Pat. No. 4,415,374 discloses that a fine grained metal composition is obtained that is suitable for forming in a partially solid, partially liquid condition. The composition is prepared by producing a solid metal composition having an essentially directional grain structure and heating the directional grain composition to a temperature above the solidus and below the liquidus to produce a partially solid, partially liquid mixture containing at least 0.05 volume fraction liquid. The composition, prior to heating, has a strain level introduced such that upon heating, the mixture comprises uniform discrete spheroidal particles contained within a lower melting matrix. The heated alloy is then solidified while in a partially solid, partially liquid condition, the solidified composition having a uniform, fine grained microstructure.

U.S. Pat. No. 3,988,180 discloses a method of heat treatment which is applied to forged aluminum alloys, whereby the mechanical characteristics and resistance against corrosion under tension are increased considerably. The method is characterized by heating prior to tempering, above the temperature of eutectic melting, while remaining below the temperature of the start of the melting at equilibrium. The liquid phase formed temporarily is resorbed progressively, while the formation of pores is avoided by a sufficiently low hydrogen content of the metal. The application of this procedure to several aluminum alloys made it possible to observe increases of the limit of elasticity and of the break load of the order of 7% and a non-rupture stress under tension in 30 days at least equal to 30 hb.

U.S. Pat. No. 5,186,236 discloses a process for producing a liquid-solid metal alloy for processing a material in the thixotropic state. In the process, an alloy melt having a solidified portion of primary crystals is maintained at a temperature between solidus and liquidus temperature of the alloy. The primary crystals are molded to give individual degenerated dendrites or cast grains of essentially globular shape and hence impart thixotropic properties to the liquid-solid metal alloy phase by the production of mechanical vibrations in the frequency range between 10 and 100 kHz in this liquid-solid metal alloy phase.

European Patent No. 0554808 A1 discloses the use of high levels of grain refiner to produce billets which need fine globular microstructure to show the necessary thixotropic behavior. The process discloses the manufacture of shaped parts from metal alloys consisting of bringing metal alloys to a molten state and using a conventional casting process to produce a simple geometric form. Then, by heating up to a temperature between the solidus and liquidus lines, a solid-liquid mixture is produced, this mixture having a melt matrix with distributed, founded, primary particles exhibiting thixotropic properties, and after a holding time, the material is conveyed to a shaping plant. In this process, to metal alloys in a liquid state is added an unexpectedly high amount of known grain refiner. After adding the unexpectedly high amount of grain refiner, the melted metal can be cooled to any desired temperature below the liquidus line and thereafter heated to a temperature between the solidus and the liquidus and held there for a time from a few to 15 minutes.

For AA (Aluminum Association) Alloy 356 (AlSi7Mg), it was disclosed that for titanium or titanium and boron grain refiner contents less than 0.18% Ti, the primary phase consisted predominantly of large dendrites, even when the sample was held for 1 hour at 578° C. Only for higher amounts of grain refiner, e.g., 0.25% titanium, it was revealed that there were isolated rounded primary particles within a holding time of 5 minutes. The same results were obtained even if the temperature was first raised to 589° C. Also, the patent disclosed that at conventional grain refiner levels, the liquid eutectic drained from the sample. The grain refiner is added to produce a smaller grain size that increases the rate for converting to the rounded grains. However, adding high levels of grain refiner can adversely affect the properties of the product and adds greatly to its cost. Further, when long holding times are involved, this often results in high porosity and excessive coarsening of silicon particles. As with high levels of grain refiner, porosity and large silicon particles impair the mechanical properties of the part being produced.

French Patent 2,266,749 discloses producing a metal alloy consisting of a mixture of liquid and solid phases in a proportion which allows the said alloy to transitorily behave like a liquid when under the influence of an exterior force, at the moment when it is shaped into a mold, and then instantaneously recover its solid properties when the force ceases. According to the patent, this procedure consists of producing the said alloy at a temperature between the equilibrium solidus and liquidus temperatures, chosen so that the preponderant fraction of liquid phase is at least 40%, and preferably in the region of 60%, and maintaining this said temperature for a time between a few minutes and some hours and preferably between 5 and 60 minutes, in a manner so that the primary dendritic structure has begun to evolve towards a globular form.

PCT Patent WO 92/13662 (Collot) discloses producing a fine grained aluminum alloy ingot by solidification under high pressure to avoid porosity. The ingot is then reheated into a semi-solid state and pressed into a mold under pressure to produce shaped pieces which have a fine globular structure free from porosity.

In another approach to preventing or destroying the dendritic microstructure, the metal, while in the liquid-solid state, is stirred or agitated to destroy or prevent the dendritic structure from forming. Such processes are disclosed, for example, in U.S. Pat. Nos. 4,865,808; 3,948,650; 4,771,818; 4,694,882; 4,524,820 and 4,108,643.

It should be understood that upon heating a body, e.g., billet or other shaped aluminum alloy product, to a temperature between liquidus and solidus, the solid shape or appearance of the body is normally not changed significantly and yet the primary phase or dendritic microstructure changes or transforms to a globular or spheroidal form with the size of the globular or spheroidal form dependent on the size of the dendritic structure and grain size at the start. Further, it should be noted that this transformation from dendrite form to globular phase takes place while the grains remain generally in solid form. However, the globular for is contained in a lower melting eutectic alloy matrix which matrix becomes molten. Generally, the molten portion of the aluminum body does not exceed about 30 to 40% by weight. However, the outward appearance of the aluminum body is not substantially changed from that of a solid body. Yet, the body takes on the attributes of a plastic body and can be formed by extruding, forging, casting, rolling, stamping, etc., with greatly reduced force.

In spite of these teachings, there is still a great need for a process that permits economic transformation of a cast product such as aluminum ingot, billet, slab or sheet to a spheroidal or globular phase for ease of semi-solid forming or forming into products without altering the chemistry of the alloy.

SUMMARY OF THE INVENTION

It is an object of the present invention to provide an improved process for thermal transformation of dendritic microstructure to the globular or spheroidal phase in an aluminum base alloy.

It is another object of the present invention to cast an improved aluminum alloy body hating microstructure suitable for thermal transformation to the globular or spheroidal phase without the excessive use of additives.

Yet, it is another object of the present invention to provide improved casting or solidification of a molten aluminum alloy body for subsequent thermal transformation of the microstructure of an aluminum base alloy to the globular or spheroidal form.

It is still another object of the present invention to significantly shorten the time at temperature between liquidus and solidus for thermal transformation to the spheroidal or globular phase.

And, yet, it is another object of this invention to provide a controlled heat-up rate to between the solidus and liquidus of an aluminum alloy for effecting transformation to a spheroidal or globular microstructure.

And, yet a further object of this invention is to provide a controlled heat-up rate to ensure uniform heating of said body of aluminum for transforming the body to a spheroidal or globular microstructure.

Still, a further object of this invention is to provide a rapid, uniform inductive heat-up rate to a controlled superheat temperature above solidus temperature to overcome the isothermal transformation barrier to effect rapid transformation of an aluminum alloy body from a dendritic microstructure to a globular or spheroidal microstructure of a primary phase in a lower melting eutectic.

Another object of the invention is to provide a method for rapid, uniform heat-up rate to superheat a body of aluminum base alloy to a temperature above the solidus temperature to thermally transform the dendritic microstructure to a globular or spheroidal microstructure without loss of the lower melting eutectic from the body.

And another object of the invention is to provide a method for rapid transformation of an aluminum alloy body to a globular or spheroidal microstructure without altering the aluminum alloy chemistry or using large additions of grain refiners.

These and other objects will become apparent from reading the specification and claims appended hereto.

In accordance with these objects, there is provided a process for casting, thermally transforming and semi-solid forming an aluminum base alloy into an article wherein the process is comprised of providing a molten body of the aluminum base alloy and casting the molten body of aluminum base alloy to provide a solidified body, the molten aluminum base alloy being solidified at a rate between liquidus and solidus temperatures of the aluminum base alloy in a range of 5° to 100° C./sec. to provide a solidified body having a fine dendritic microstructure. Preferably, the microstructure of the body has a dendritic arm spacing in the range of 2 to 50 μm and a grain size in the range of 20 to 200 μm. Thereafter, the solidified body is superheated to a superheating temperature 3° to 50° C. above the solidus temperature of the aluminum base alloy. When the entire aluminum base alloy body reaches the superheating temperature, thermal transformation of the dendritic microstructure to a globular or spheroidal microstructure is effected. The globular phase is disposed in a lower melting liquid phase. The thermally transformed body of the globular or spheroidal microstructure dispersed in a lower melting liquid phase is formed into said article. The transformation can occur in a very short period, and transformation is normally effected when the entire body reaches the superheated temperature. Normally, a few seconds, e.g., less than 40 seconds, of the superheated temperature ensures transformation of the complete body.

DETAILED DESCRIPTION OF THE PREFERRED EMBODIMENTS

Figure 1:
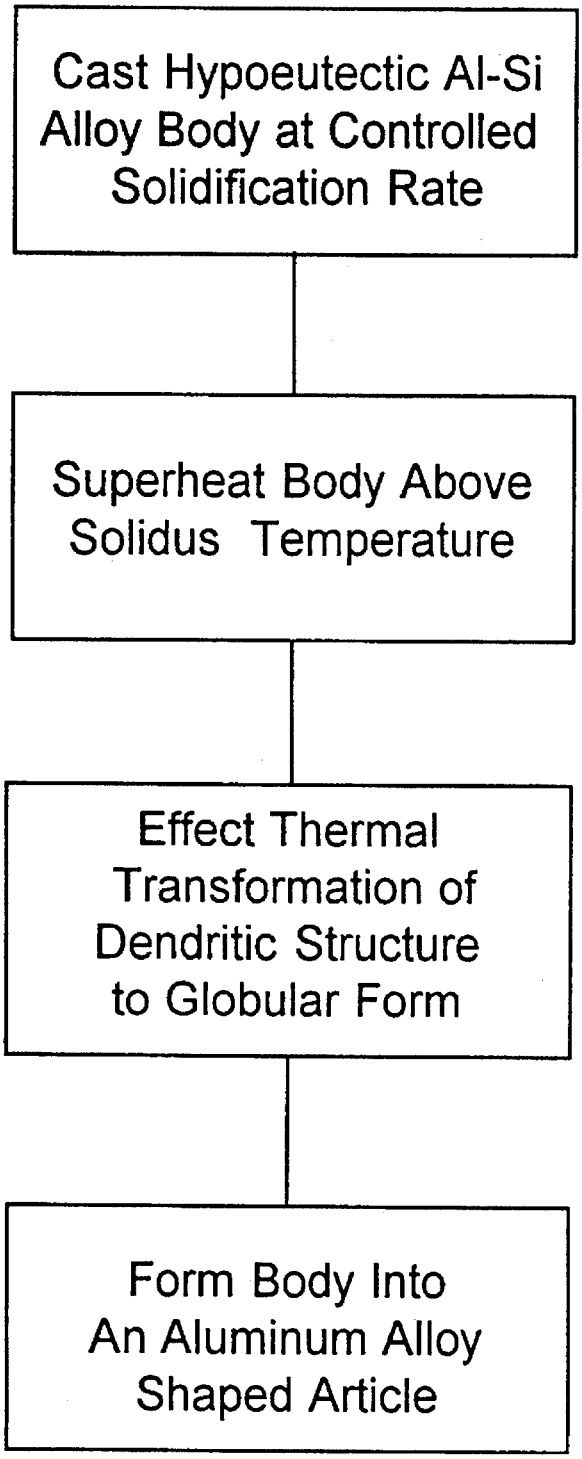
FIG. 1 is a flow chart showing steps in the process of the invention.

Referring to FIG. 1, there is shown a flow chart of the steps of the invention. A body of molten aluminum alloy is cast at a controlled solidification rate. Suitable aluminum alloys that can be cast and formed in accordance with the invention include hypoeutectic alloys having high levels of silicon. For example, the alloy can comprise from about 2.5 to 11 wt. % silicon with preferred amounts being about 5.0 to 7.5.

In addition, the alloy can contain magnesium and titanium, other incidental elements and impurities. Magnesium can range from about 0.2 to 2 wt. %, preferably 0.2 to 0.7 wt. %, the remainder aluminum, incidental elements and impurities. The amount of titanium is the conventional amount used with such alloys. The amount of titanium is normally less than 0.2 wt. % and preferably in the range of 0.01 to 0.2 wt. % as titanium only, with typical ranges being in the range of 0.05 to 0.15 wt. % and preferably 0.10 to 0.15 wt. %. In some of these casting alloys, copper can range from 0.2 to 5 wt. % for the AlSiCu alloys of the AA300 series aluminum alloys. In the AA500 series alloys (AlMg) where silicon is maintained low, e.g., less than 2.5 wt. %, magnesium can range from 2 to 10.6 wt. %. Further, in AA700 (AlZnMg) series alloys, magnesium can range from about 0.2 to 2.4 wt. %, and zinc can range from about 2 to 8 wt. %. The ranges for AA300, AA500 and AA700 are provided in the "Registration Record of Aluminum Association Alloy Designations and Chemical Composition Limits for Aluminum Alloys in the Form of Castings and Ingot", revised January 1989, and are incorporated herein by reference.

Typical of such alloys are Aluminum Association alloys AA356 and AA357, the compositions of which are incorporated herein by reference. While the invention is particularly suitable for alloys as noted, the invention can be applied to any aluminum alloy that can be thermally transformed from a microstructure, e.g., dendritic structure, to a globular phase. Such alloys can include Aluminum Association Alloys 2000, 6000 and 7000 series incorporated herein by reference.

For purposes of the present invention, a molten aluminum base alloy is cast into a solidified body at a rate which provides a controlled microstructure or grain size. Thus, for the present invention, it is preferred that the solidified body has a grain size in the range of 20 to 250 μm, preferably 20 to 200 μm. Larger grains can be transformed in accordance with the invention; however, larger grains are less desirable for forming because they are more difficult to form in the semi-solid state.

For purposes of obtaining the desired microstructure for thermally transforming in accordance with the invention, the molten almninum has to be cast at a controlled solidification rate. It has been discovered that controlled solidification in combination with a subsequent controlled thermal heating of the solidified aluminum alloy body results in very efficient transformation of dendritic microstructure to spheroidal or globular microstructure contained in a lower melting eutectic. Because of this combination, the aluminum base alloy body can be thermally transformed in a very short period of time. This has the advantage of minimizing cell growth which is a problem with long times. Further, with the short transformation time, silicon in the aluminum alloy does not have the opportunity to grow into large brittle particles which impair the properties of the formed part. In addition, the shorter transformation times greatly minimizes the development of porosity in the body. Further, the short transformation time is an important economic consideration.

The body can be cast by non-stirred electromagnetic casting, belt, block or roll casting where a slab is produced having the required grain structure. Aluminum alloy billet having high levels of silicon, e.g., 5 to 8 wt. % and having a diameter in the range of 1 inch to 7 inches can be produced to have a grain structure which is highly suitable for thermal transformation in accordance with the invention.

For purposes of producing the billet in accordance with the invention, casting may be accomplished by a mold process utilizing air and liquid coolant wherein the billet can be solidified at a rate which provides the desired dendritic grain structure. The grains can have a size ranging from 20 to 250 μm and a dendritic ann spacing of 2 to 50 microns. The air and coolant utilized in the molds are particularly suited to extracting heat from the body of molten aluminum alloy to obtain a solidification rate in the range of 5° to 50° C./sec. for billet having a diameter in the range of 1 to 7 inches. Molds using air and liquid coolant of the type which have been found particularly satisfactory for casting molten aluminum alloys having the dendritic structure for transforming to a non-dendritic or globular microstructure in accordance with the invention are described in U.S. Pat. No. 4,598,763.

The coolant for use with these molds for the invention is comprised of a gas and a liquid where gas is infused into the liquid as tiny, discrete undissolved bubbles and the combination is directed on the surface of the emerging ingot. The bubble-entrained coolant operates to cool the metal at an increased rate of heat extraction; and if desired, the increased rate of extraction., together with the discharge rate of the coolant, can be used to control the rate of cooling at any stage in the casting operation, including during the steady state casting stage.

For casting metal, e.g., aluminum alloy to provide a microstructure suitable for purposes of the present invention, molten metal is introduced to the cavity of an annular mold, through one end opening thereof, and while the metal undergoes partial solidification in the mold to form a body of the same on a support adjacent the other end opening of the cavity, the mold and support are reciprocated in relation to one another endwise of the cavity to elongate the body of metal through the latter opening of the cavity. Liquid coolant is introduced to an annular flow passage which is circumposed about the cavity in the body of the mold and opens into the ambient atmosphere of the mold adjacent the aforesaid opposite end opening thereof to discharge the coolant as a curtain of the same that impinges on the emerging body of metal for direct cooling. Meanwhile, a gas which is substantially insoluble in the coolant liquid is charged under pressure into an annular distribution chamber which is disposed about the passage in the body of the mold and opens into the passage through an annular slot disposed upstream from the discharge opening of the passage at the periphery of the coolant flow therein. The body of gas in the chamber is released into the passage through the slot and is subdivided into a multiplicity of gas jets as the gas discharges through the slot. The jets are released into the coolant flow at a temperature and pressure at which the gas is entrained in the flow as a mass of bubbles that tend to remain discrete and undissolved in the coolant as the curtain of the same discharges through the opening of the passage and impinges on the emerging body of metal. With the mass of bubbles entrained therein, the curtain has an increased velocity, and this increase can be used to regulate the cooling rate of the coolant liquid, since it more than offsets any reduction in the thermal conductivity of the coolant. In fact, the high velocity bubble-entrained curtain of coolant appears to have a scrubbing effect on the metal, which breaks up any film and reduces the tendency for film boiling to occur at the surface of the metal, thus allowing the process to operate at the more desirable level of nucleate boiling, if desired. The addition of the bubbles also produces more coolant vapor in the curtain of coolant, and the added vapor tends to rise up into the gap normally formed between the body of metal and the wall of the mold immediately above the curtain to cool the metal at that level. As a result, the metal tends to solidify further up the wall than otherwise expected, not only as a result of the higher cooling rate achieved in the manner described above, but also as a result of the build-up of coolant vapor in the gap. The higher level assures that the metal will solidify on the wall of the mold at a level where lubricating oil is present; and together, all of these effects produce a superior, more satin-like, drag-free surface on the body of the metal over the entire length of the ingot and is particularly suited to thermal transformation.

When the coolant is employed in conjunction with the apparatus and technique described in U.S. Pat. No. 4,598,763, this casting method has the further advantage that any gas and/or vapor released into the gap from the curtain intermixes with the annulus of fluid discharged from the cavity of the mold and produces a more steady flow of the latter discharge, rather than the discharge occurring as intermittent pulses of fluid.

As indicated, the gas should have a low solubility in the liquid; and where the liquid is water, the gas may be air for cheapness and ready availability.

During the casting operation, the body of gas in the distribution chamber may be released into the coolant flow passage through the slot during both the butt forming stage and the steady state casting stage. Or, the body of gas may be released into the passage through the slot only during the steady state casting stage. For example, during the butt-forming stage, the coolant discharge rate may be adjusted to undercool the ingot by generating a film boiling effect; and the body of gas may be released into the passage through the slot when the temperature of the metal reaches a level at which the cooling rate requires increasing to maintain a desired surface temperature on the metal. Then, when the surface temperature falls below the foregoing level, the body of gas may no longer be released through the slot into the passage, so as to undercool the metal once again. Ultimately, when steady state casting is begun, the body of gas may be released into the passage once again, through the slot and on an indefinite basis until the casting operation is completed. In the alternative, the coolant discharge rate may be adjusted during the butt-forming stage to maintain the temperature of the metal within a prescribed range, and the body of gas may not be released into the passage through the slot until the coolant discharge rate is increased and the steady state casting stage is begun.

The coolant, molds and casting method are further set forth in U.S. Pat. Nos. 4,598,763 and 4,693,298, incorporated herein by reference.

While the casting procedure for the present invention has been described in detail for producing billet having the necessary structure for thermal transformation in accordance with the present invention, it should be understood that the other casting methods can be used to provide the solidification rates that result in the grain structure necessary to the invention. As noted earlier, such solidification can be obtained by belt, block or roll casting and electromagnetic casting.

When billet is cast in accordance with these procedures for an alloy such as AA356, the casting process can be controlled to produce a microstructure having a grain size in the range of 20 to 200 μm. In the present invention, small grains are beneficial in aiding transformation to the globular microstructure. In the present invention, large additions of grain refiner such as $TiB_2$ are not necessary to obtain the grain structure that is suited to transformation. Further, it is believed that such large amounts of grain refiner can have harmful effects on product quality.

Figure 2A:
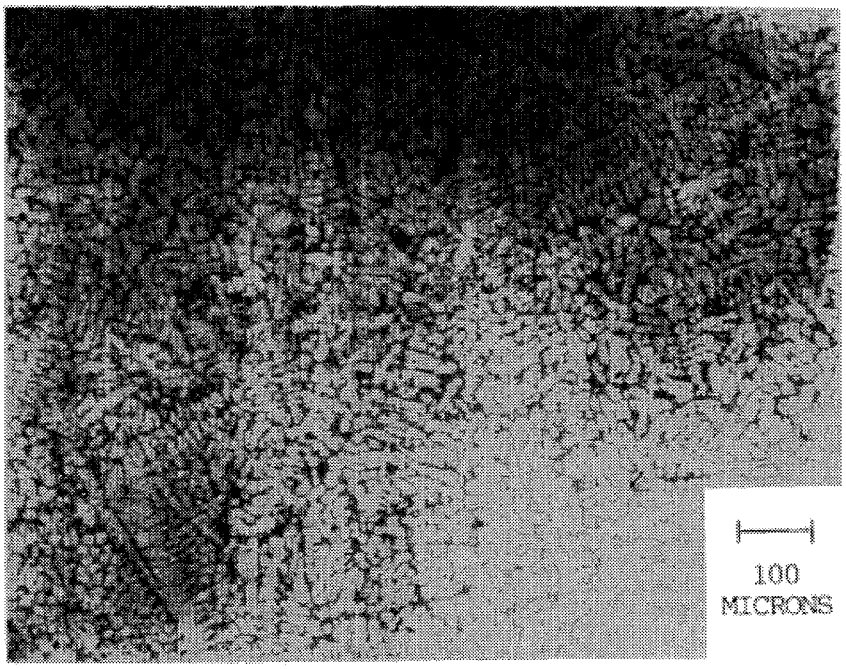
FIG. 2*a* is a micrograph (no etch) showing the grain size and dendrite arms of small, as-cast billet of AA356 alloy cast in accordance with the invention.
Figure 2B:
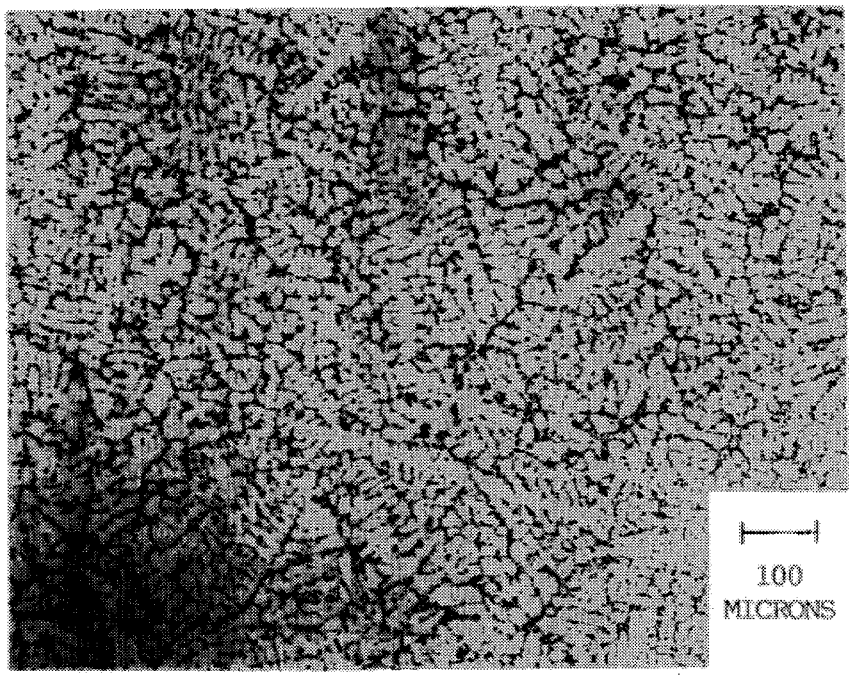
FIG. 2*b* is a micrograph showing a homogenized structure of AA356 billet cast in accordance with the invention.
Figure 2C:
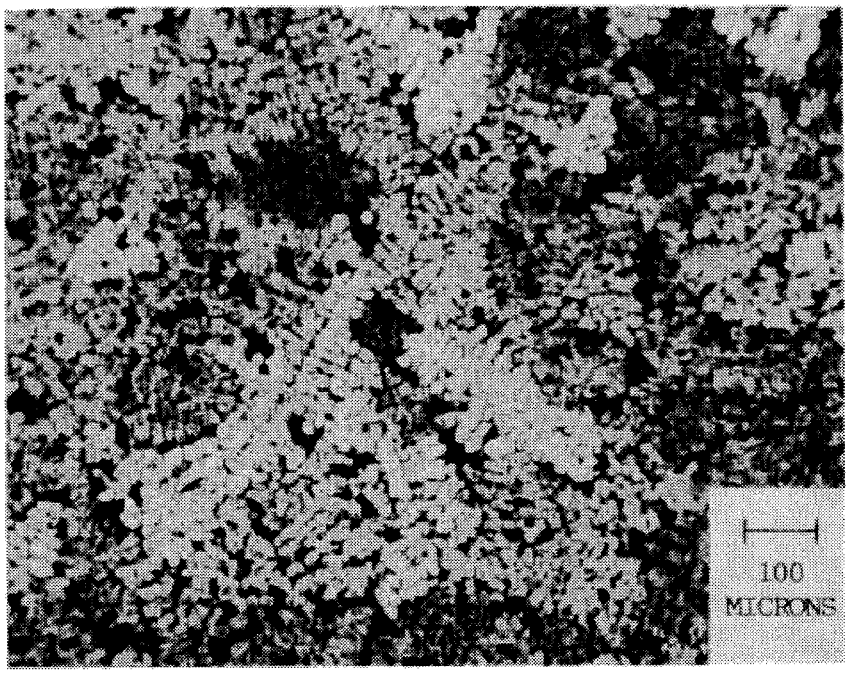
FIG. 2*c* is a micrograph of the alloy of FIG. 2*a* except with a 2 minute, 20% CuCl etch.

When a 3.2-inch billet of AA356 alloy containing 7.04 wt. % Si, 0.36 wt. % magnesium, 0.13 wt. % titanium, the remainder comprising aluminum, is cast employing a mold using air and water as a coolant, a cooling rate in the range of 15° to 20° C./sec. provides a satisfactory dendritic grain structure having a dendritic arm spacing in the range of 10 to 15 μm and an average grain size of about 120 μm for transforming to a non-dendritic or globular structure in accordance with the invention. The cooling rate is obtained using coolant, e.g., water, having gas such as air infused therein. A typical dendritic microstructure (without etching) of AA356 having the above composition cast in accordance with these procedures is shown in FIG. 2*a*. The microstructure with a 2 minute, 20% CuCl etch is shown in FIG. 2*c*.

In the present invention, when silicon is present in the alloy, the silicon particle can have a size up to 30 μm. However, it is preferred to have the silicon particles not exceed 20 μm and typically in the range of 5 to 20 μm.

When aluminum billet is utilized and cast in accordance with this invention, normal additional steps are not necessary. For example, billets cast in accordance with the invention have a thin surface chill zone having a depth of less than 0.01 inch and such surface is oxide free and therefore scalping is not necessary. In addition, such billets have a fine uniform grain structure throughout and are substantially free of shrinkage porosity.

Figure 3A:
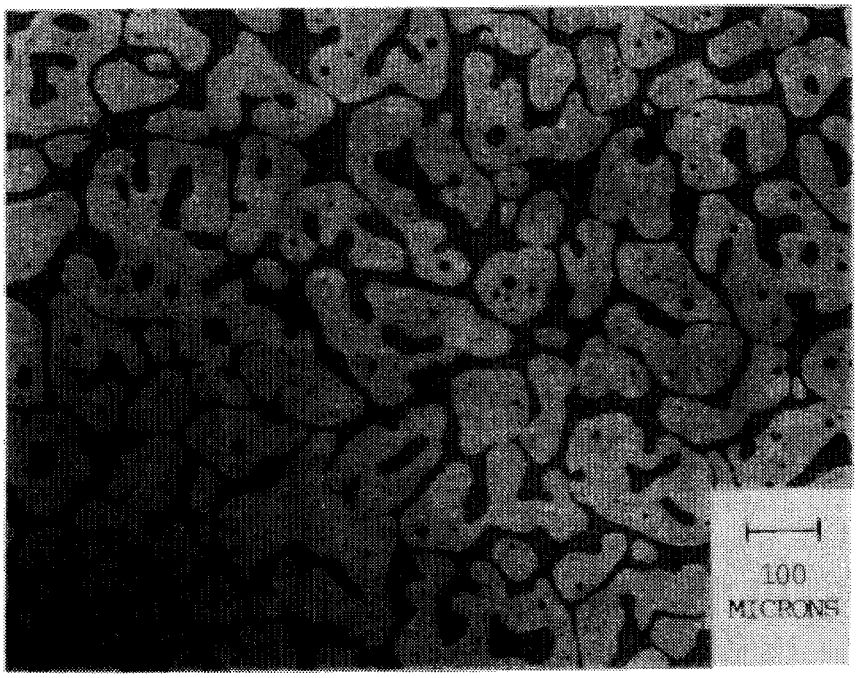
FIG. 3*a* is a micrograph showing the microstructure of AA356 after being thermally transformed to a globular form.
Figure 3B:
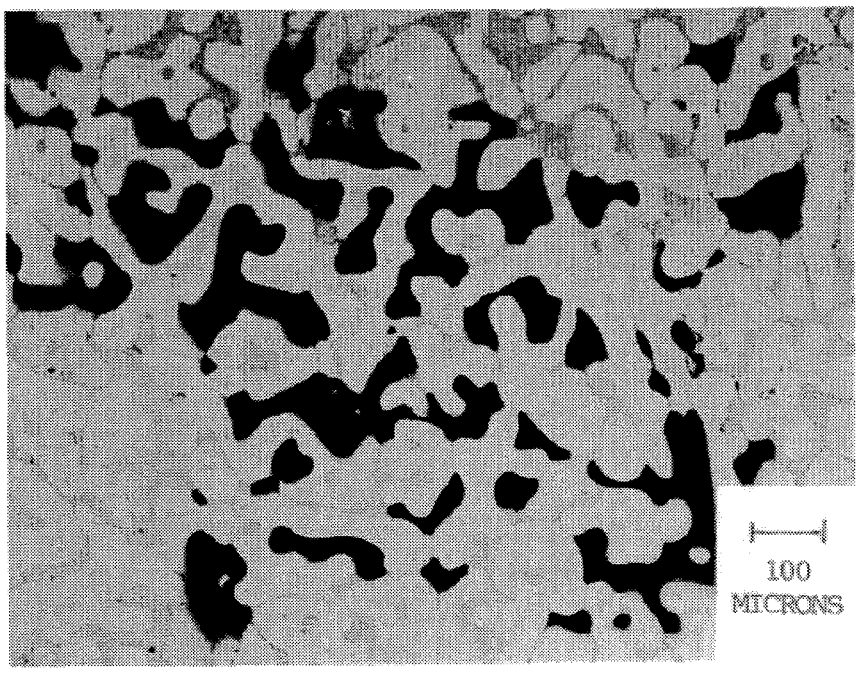
FIG. 3*b* is a micrograph of AA356 showing the thermally transformed structure and the presence of porosity denoted by dark areas.

In another aspect of the invention, it has been found that some alloys can develop porosity after thermal transformation to the globular or spheroidal form, as shown in FIG. 3*b* for AA356 alloy. Such porosity is detrimental to the properties of the end product and is normally not removed during the forming step. It has been discovered that subjecting a body of aluminum alloy cast in accordance with the invention to an homogenization step (FIG. 2*b*, homogenized structure) followed by the thermal transformation steps of the invention provides a thermally transformed body and shaped product substantially free of porosity, as shown in FIG. 3*a* for AA356. Homogenization can be accomplished by heating a body of the alloy to a temperature of about 482° to 593° C. Time at temperature for purposes of homogenization can range from about ½ to 24 hours. Further, the body may be worked after homogenization such as by rolling, extruding, forging or the like prior to the thermal transformation step.

Figure 4:
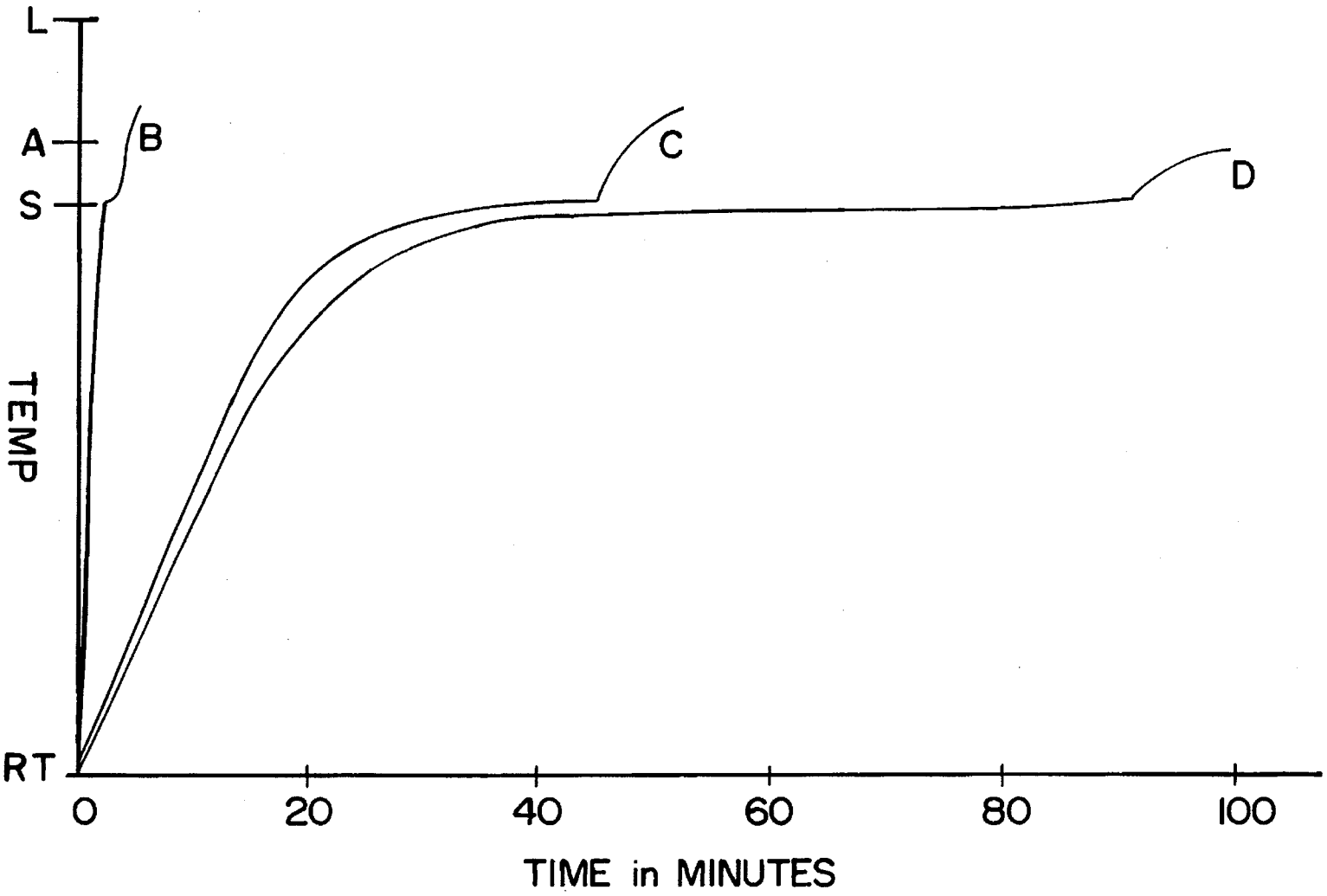
FIG. 4 is a graph illustrating the heat-up rate, superheated temperature, and time to thermally transform a dendritic microstructure to a non-dendritic structure.

After the body of aluminum alloy has been cast in accordance with the invention to provide the required microstructure, it is heated to a superheated temperature to initiate incipient melting and transformation from a dendritic or a homogenized microstructure to a non-dendritic microstructure, such as a globular structure contained in a lower melting eutectic. If the aluminum alloy body is comprised of AA356 alloy, the lower melting eutectic where incipient melting starts contains more Si (solvent) and the globular or rounded structure would be comprised of a higher melting material containing less silicon or more aluminum (solute). The globules or spheroids have a dimension in the range of 50 to 250 μm, depending on the fineness of the starting grain structure. By superheating or superheated temperature in the present invention is meant that the body of aluminum alloy is heated to a temperature substantially above its solidus or eutectic temperature without melting the entire body but initiation of incipient melting of the lower melting eutectic and silicon particles. For casting alloys such as AA300 series, this can be in a temperature range of 3° to 50° C. (inclusive of all numbers in the range as if set forth) above the solidus temperature. Normally, the heat-up time to superheated temperature and transformation time does not exceed 5 minutes when induction heating is used. By reference to FIG. 4, there is shown a graphic representation of the heat-up wherein S represents the solidus temperature, L represents the liquidus temperature, A represents the superheated temperature, and RT is room temperature. Thus, it will be seen from FIG. 4 that the body of alloy is heated from room temperature past the solidus temperature to superheated temperature A as quickly as possible, with heat-up rates of 200° to 300° C./min. or faster contemplated. As presently understood, there is no limitation with respect to the speed of heat-up, with faster heat-up rates being preferred. Preferably, heat-up rates greater than 30° C./min. are used, with typical heat-up rates being in the range of 45° to 350° C./min. The slower heat-up rates are less preferred. As noted earlier, faster heat-up rates are advantageous because they minimize grain or globular growth, coarsening of elemental silicon particles and porosity. FIG. 4 shows induction heat-up rate B of the invention compared to conventional resistance furnace heating rates C and D and the time necessary to overcome the barrier to forming a non-dendritic structure.

Because of the very short time required to heat from room temperature to superheated temperature and to transform, it is important that the body of aluminum alloy be heated uniformly to ensure that all parts of the body become uniformly transformed to the globular form. Inductive heating is preferred because of the fast heat-up rates that can be achieved. Resistive heating also may be used for heating purposes; however, it is difficult to get fast heat-up rates, e.g., greater than 100° C./min. with resistive heating and thus this mode of heating is less preferred.

In the present invention, it has been discovered that heating quickly to a superheated temperature results in almost instantaneous conversion or transformation of the dendritic structure to a globular or spheroidal structure. Holding time at the superheated temperature is necessary to ensure that the entire body has uniformly reached the superheated temperature. This is particularly critical in large diameter bodies, for example. When the entire body has reached the superheated temperature, it has been discovered that transformation has occurred and the body may be rapidly cooled to prevent globular growth or reformation of dendrites.

In most instances, when heating of the body is accomplished by resistance or induction heating, heat enters at the surface of the body. Thereafter, heat is transferred by conduction to the interior of the body. Thus, although by superheating, thermal transformation occurs very rapidly at any given location, a finite time is required to bring the entire body to the superheated temperature and thereby effect transformation of the structure in the entire sample. Thus, time at the superheated temperature depends on the size of the body. For billet of 3.2 inch diameter, transformation is effected in less than 30 seconds upon reaching the superheated temperature. This allows time for the entire body to reach the superheated temperature. For 7 inch diameter billet, the time can reach 4 or minutes. However, these times depend to some extent on the equipment used for heating, and shorter times are preferred.

While the inventors do not wish to be bound by any theory of invention, it is believed that superheating the alloy body is necessary because a new phase has to be created where silicon particles are dissolved to promote thermal transformation to globular form or effect semi-solid thermal transformation. To form a new phase, a new interface must be created. In the subject invention, a small nucleus of liquid is required to be formed inside a solid alloy. This is the interface between solid and liquid, and it has certain energy associated with its creation, represented by σ, which has the units of Joules/m$^2$. Balancing this surface-free energy is the volumetric-free energy change associated with melting:

$$\Delta G_v = \frac{\Delta H \cdot \Delta T}{T_e} \tag{1}$$

where

ΔH is the latent heat of fusion (c. $1.36\times10^9$ Joules/m$^3$)

$T_e$ is the equilibrium eutectic temperature, and

ΔT is the superheat ($\Delta T = T - T_e$)

Figure 5:
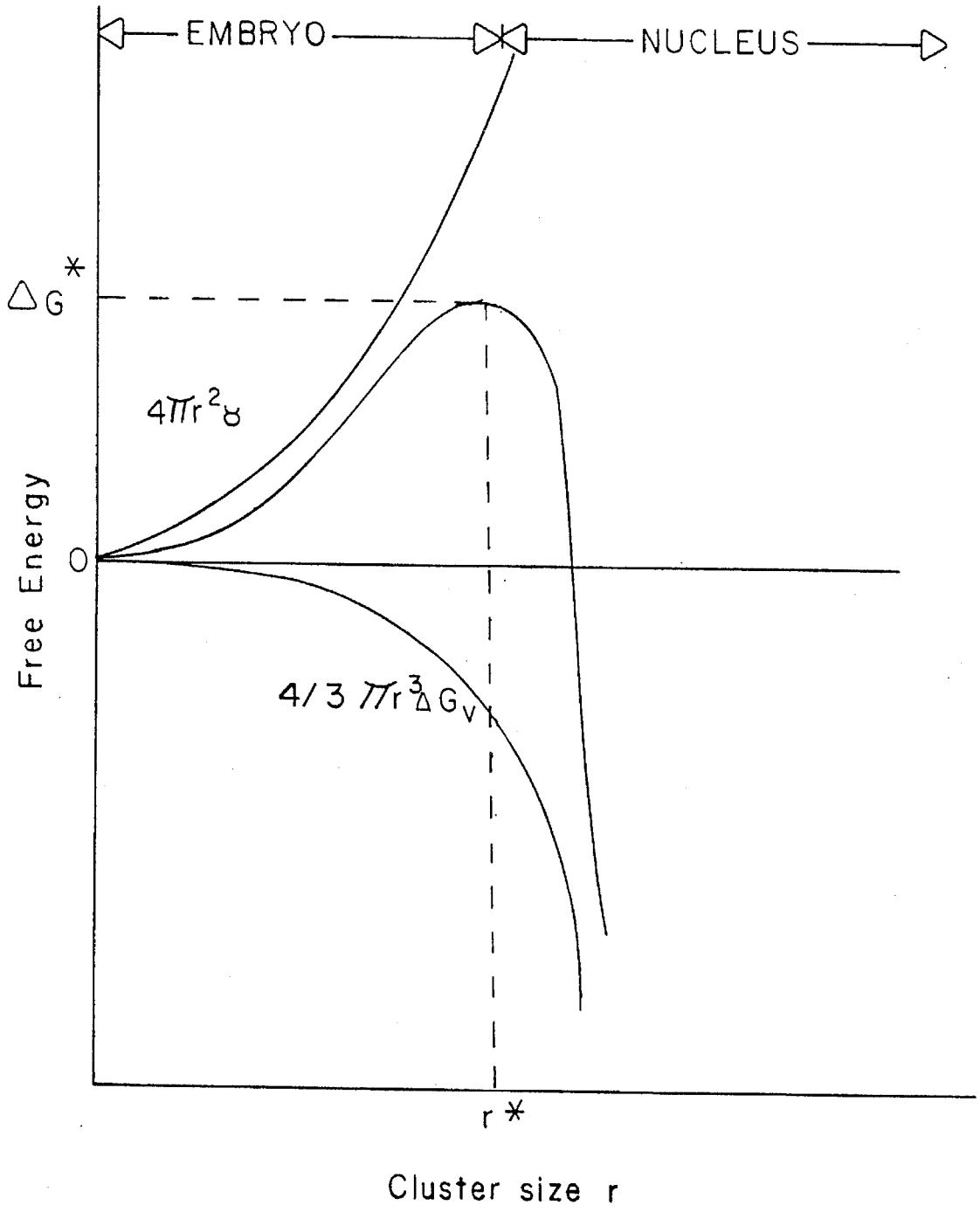
FIG. 5 is a schematic plot of the free energy to nucleation at constant temperature.

The total free energy associated with the formation of a small embryo of the new phase is given by the equation:

$$\Delta G = 4\pi r^2\sigma - \frac{4}{3}\pi r^3 \Delta G_v \tag{2}$$

and is plotted schematically in FIG. 5. The free energy of the embryo is positive at first, because the surface area is very large compared to the volume when the radius, r, is small. The free energy then reaches a maximum or critical value, $\Delta G^*$, at a critical radius, $r^*$. This critical free energy represents a barrier to the nucleation of the new phase, and must be supplied from the thermal energy available as fluctuations always present in heated samples. Since the slope of the free energy curve is zero at $r^*$, it can be shown that:

$$\Delta G^* = \frac{16\pi\sigma^3}{3\Delta G \frac{2}{v}} \quad (3)$$

The nucleation rate (rate of formation of stable nuclei per unit volume per second) is given by the relation:

$$R = \frac{nkT}{h} \exp - \left( \frac{\Delta G^* + \Delta G_D}{kT} \right) \quad (4)$$

where:

n is the number of atoms per unit volume k is Boltzmann's constant h is Planck's constant T is the the thermodynamic or absolute temper (T≅577° C.+273=850K.)

$\Delta G_D$ is the activation energy associated with diffusion of atoms in the solid The diffusion of aluminum can be represented by $\Delta G_D/kT \cong 22.2$. The reciprocal of the nucleation rate given in equation 4 (1/R) is equal to the time required to form a stable nuclei in a unit volume. Calculation times for nucleation of liquid to occur are provided in Table I:

TABLE I

Calculated Times for Nucleation of Liquid During Semi-solid Thermal Transformation ($\sigma$ is equal to 0.015 Joules/m$^2$)

| Superheat (ΔT, °C.) | Nucleation Time (sec) |
|---|---|
| 1 | $10^{780}$ |
| 2 | $10^{172}$ |
| 3 | $10^{58}$ |
| 4 | $10^{19}$ |
| 5 | 2.13 |
| 6 | $10^{-10}$ |
| 7 | $10^{-16}$ |

It is readily seen from these calculations that a certain amount of superheat must be supplied for the melting and transformation to occur in a very short time. That is, the nucleation process acts to produce an isothermal transformation barrier which must be overcome by providing a certain amount of superheat.

Figure 6:
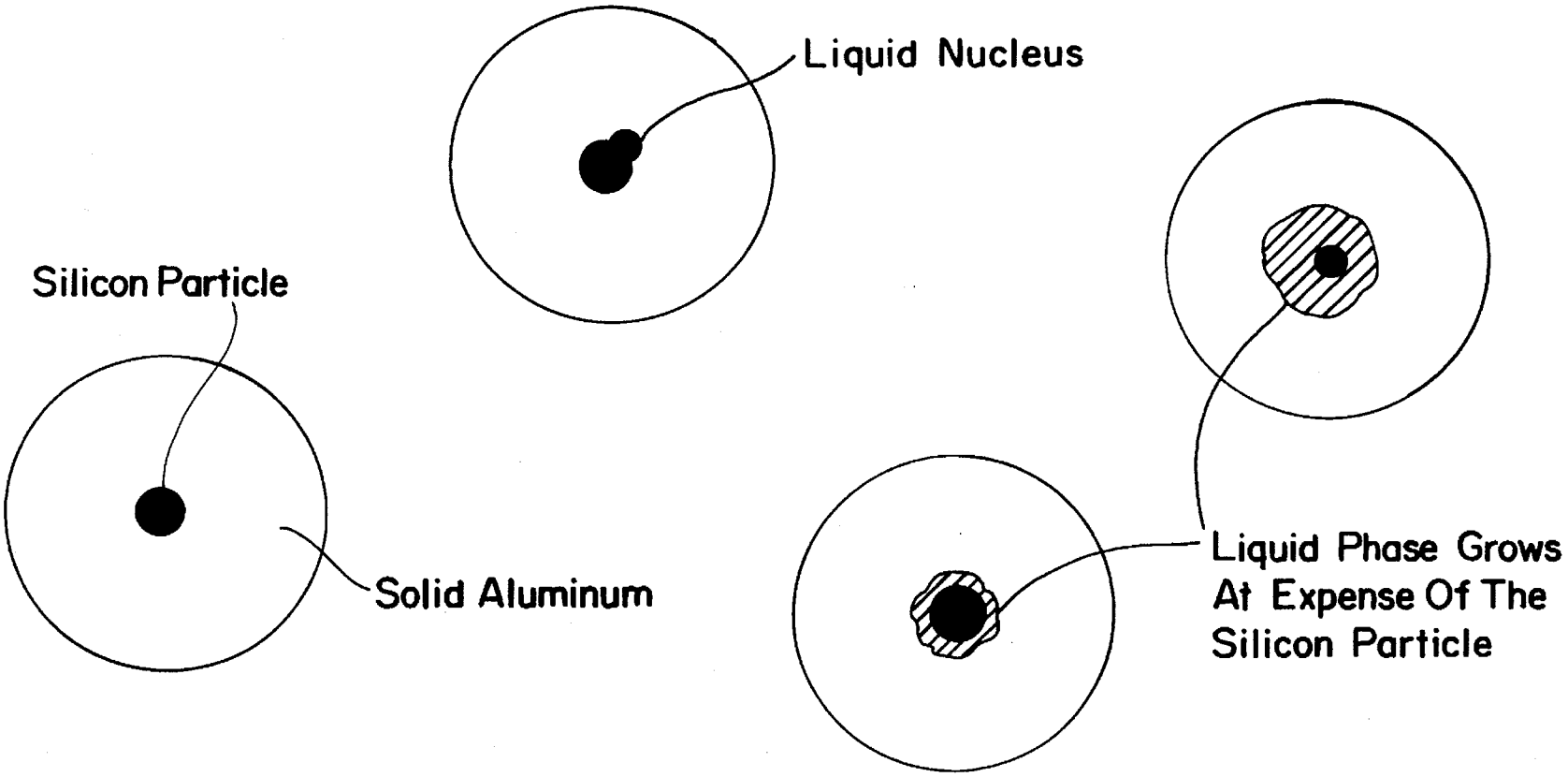
FIG. 6 is a schematic illustration of the melting process near a silicon particle in aluminum silicon alloy.

The isothermal transformation barrier suggests that the nucleation of the liquid phase occurs by heterogeneous nucleation, on existing discontinuities in the solid metal and that the most likely nuclei are the numerous silicon particles present in the alloy. FIG. 6 illustrates schematically what must occur. At first, there is a silicon particle surrounded by solid aluminum in which just over 1% of silicon is present in solid solution. At some point, a small amount of liquid nucleates. It is believed that this happens on the surface of the silicon particle, as noted above. The small nucleus rapidly grows to a film which covers the silicon particle, but further growth of the liquid film can occur only as the silicon particle dissolves, as silicon diffuses through the liquid layer to the solid aluminum shell. Finally, all of the silicon dissolves, and final equilibrium state of liquefaction is reached.

The isothermal transformation barrier may be significantly longer in alloys which do not have large numbers of silicon particles which may act as heterogeneous nuclei for the liquid phase.

In another embodiment of the invention, the cast body of aluminum alloy is heated to superheated temperature to overcome the barrier to effecting thermal transformation of the dendritic structure. After a period not greater than 2 minutes at the superheating temperature, the body is quenched and completion of the transformation effected upon reheating for purposes of hot forming the body into the final shaped article.

Any means of heating may be used which is effective in providing fast heat-up rates for reaching the desired superheated temperature efficiently. Thus, preferably the heating means for heating the aluminum alloy body is an induction heating mean.

Suitable induction heating in accordance with the invention may be accomplished using ASEA Brown Boveri melting induction furnace, Type ITM-300 with an output of 150 KW at 1000 HZ and an input of 480 volts, 204 amps and 60 HZ. Typically, for alloys such as AA357, the liquid fraction can comprise 30% to 55% of the body. It should be understood that the dendritic microstructure does not melt but rather it is transformed in several stages into the globular or spheroidal phase as noted. The liquid fraction is the lower melting eutectic comprised mostly of aluminum and silicon of eutectic composition, e.g., Al 12% Si.

It will be appreciated that the aluminum alloy body can be used in the semi-solid form after transformation has occurred or it can be rapidly cooled in less than 10 seconds and reheated. After reheating the body still retains the thermally transformed structure.

The present invention has the advantage that the thermally transformed semi-solid structure can be obtained quickly and economically. Further, low pressure can be used for molding or stamping parts therefrom and thus more intricate shapes can be obtained. In addition, this invention has the advantage that porosity-free transformed bodies or shaped articles can be produced.

For purposes of forming the thermally transformed body of aluminum alloy, preferably the body is reheated to the semi-solid form at comparable rates. Thus, for purposes of the present invention, heat-up rates from room temperature in the range of 30° to 350° C./min. to semi-solid forming temperature are contemplated.

The following Examples are still further illustrative of the invention.

EXAMPLE 1

An aluminum casting alloy (Aluminum Association Alloy 356) containing 7.04 wt. % silicon, 0.36 wt. % magnesium, 0.13 wt. % titanium, the balance aluminum and incidental impurities, was cast into a 3.2-inch diameter billet. The billet was cast using casting molds utilizing air and liquid coolant (available from Wagstaff Engineering, Inc., Spokane, Wash.). The air/water coolant was adjusted in order that the body of molten aluminum alloy was solidified at a rate of 15° to 20° C./sec. A micrograph of a cross section of the billet showed a dendritic grain structure, as shown in FIG. 2*a*, and had an average grain size of 120 μm. For inductively heating, a frequency of 810 Hz was used and the input was 910 volts, 120 amps.

One inch square sections of the 3.2 inch diameter billet was then inductively superheated from room temperature (21° C.) to 588° C. which is approximately 22° F. above solidus temperature for this alloy. The average heat-up rate was about 278° C./min. The sections were held at 588° C. for less than 0.5, 2 and 3 minutes. Thereafter, the samples were quenched with cold water to room temperature. Micrographs of the thermally treated samples showed that all samples (held for less than 0.5, 2 and 3 minutes) were transformed into a globular form contained in a lower melting eutectic alloy (FIG. 3*a*). The globules had an average diameter of 120 μm. The silicon particles had a size of less than 5 μm.

EXAMPLE 2

A sample of the cast billet of Example 1 was heated up to just above the solidus temperature (577° C.) without superheating using the induction heater of Example 1. The heat-up rate was 278° C./min. The sample was held at this temperature for 7 minutes and then quenched to room temperature. The quenched sample was examined and it was found that the microstructure had not transformed to the globular form.

EXAMPLE 3

The aluminum casting alloy of Example 1 was cast into 6" diameter billet using the casting process of Example 1. The air/water coolant was adjusted in order that the body of molten aluminum alloy was solidified at a rate of 5°–10° C./sec. A micrograph of the structure showed a dendritic micro structure and an average grain size of 200 μm. A sample of the billet 1 inch square was then inductively superheated from room temperature to a superheated temperature of 588° C. The heat-up rate was approximately 278° C./min. After 5 seconds at the superheated temperature, the body was quenched with cold water. Examination of the microstructure showed that the dendritic structure was transformed to globular form. The globules or rounded structures had a diameter of about 200 μm. The larger silicon particles were less than 5 μm.

EXAMPLE 4

A sample of the cast billet of Example 3 was heated up to just above the solidus temperature (577° C.) without superheating using the induction heater of Example 1. The heat-up rate was 278° C./min. The sample was held at this temperature for 10 minutes and then quenched to room temperature. The quenched sample was examined and it was found that the microstructure had not transformed to the globular form.

EXAMPLE 5

An aluminum casting alloy (Aluminum Association Alloy 6069) containing 0.94 wt. % silicon, 0.74 wt. % copper, 1.44 wt. % magnesium, 0.22 wt. % chromium, 0.04 wt. % Ti, 0.11 wt. % V, the balance aluminum and incidental impurities, was cast into a 3.5 inch diameter billet. The billet was cast using casting molds using air and water coolant. The air/water coolant was adjusted in order that the body of molten aluminum alloy was solidified at a rate of 15°–20° C./sec. A micrograph of a cross section of the billet showed a dendritic grain structure and had an average grain size of 80 μm.

A sample of the billet having a 1×1×7 inch length was then inductively superheated from room temperature (21° C.) to 627° C. which is about 50° C. above solidus temperature for this alloy. The heat-up rate was 278° C./min. After 5 seconds at the superheated temperature, 1160° F., the aluminum alloy body was quenched with cold water to room temperature. A micrograph of the thermally treated sample showed that the dendritic microstructure was transformed into a globular form. The globules had a diameter of 80 μm. The silicon particles had a size of less than 5 μm.

While the invention has been described in terms of preferred embodiments, the claims appended hereto are intended to encompass other embodiments which fall within the spirit of the invention.

What is claimed is:

1. A process for casting, thermally transforming and semi-solid forming an aluminum base alloy into an article, the process comprising the steps of:

(a) providing a molten body of said aluminum base alloy;

(b) casting said molten body of aluminum base alloy to provide a solidified body, said molten aluminum base alloy being solidified at a rate between liquidus and solidus temperatures of the aluminum base alloy in a range of 5° to 100° C./sec. to provide an entire solidified body having a dendritic microstructure and having a gain size in the range of 20 to 250 μm;

(c) thereafter, heating said solidified body to bring said body to a superheated temperature of 3° to 50° C. above said solidus temperature of said aluminum base alloy while maintaining said body in a solid shape said heating to said superheated temperature being at a rate greater than 30° C. per minute;

(d) effecting thermal transformation of said body having said dendritic structure when said entire body is uniformly heated to said superheated temperature; and (e) forming said body having said non-dendritic structure in a semi-solid condition into said article.

2. The method in accordance with claim 1 including heating said body at a rate of greater than 45° C. per minute.

3. The method in accordance with claim 1 including heating said body to said superheated temperature at a rate in the range of 30° to 1000° C./min.

4. The method in accordance with claim 1 including maintaining said body at said superheated temperature for a period in the range of about 1 second to 60 seconds.

5. The method in accordance with claim 1 including maintaining said body at said superheated temperature for a period in the range of about 5 to 40 seconds.

6. The method in accordance with claim 1 wherein said dendritic structure is thermally transformed to a globular structure dispersed in a lower melting eutectic phase.

7. The method in accordance with claim 1 wherein said aluminum base alloy comprises 2.5 to 11 wt. % silicon.

8. The method in accordance with claim 1 wherein said aluminum base alloy comprises 5 to 7.5 wt. % silicon.

9. The method in accordance with claim 1 wherein said aluminum base alloy comprises 0.2 to 2.0 wt. % magnesium.

10. The method in accordance with claim 1 wherein said aluminum base alloy comprises 0.01 to 0.2 wt. % titanium.

11. The method in accordance with claim 1 wherein said aluminum base alloy comprises 0.02 to 0.15 wt. % titanium.

12. The method in accordance with claim 1 wherein said aluminum base alloy comprises less than 0.1 wt. % titanium.

13. The method in accordance with claim 1 wherein said aluminum base alloy comprises 2 to 11 wt. % silicon, 0.2 to 0.7 wt. % magnesium and 0.02 to 0.15 wt. % titanium.

14. The method in accordance with claim 1 including resistively heating said body to a superheated temperature.

15. The method in accordance with claim 1 including inductively heating said solidified body to a superheated temperature.

16. The method in accordance with claim 1 wherein said alloy comprises 0.2 to 5 wt. % copper.

17. A process for casting, thermally transforming and semi-solid forming an aluminum base alloy into an article, the process comprising the steps of:

(a) providing a molten body of said aluminum base alloy comprising 4 to 9 wt. % silicon, 0.2 to 2.0 wt. % magnesium, and 0.02 to 0.15 wt. % titanium, balance aluminum and incidental elements and impurities;

(b) casting said molten body of aluminum base alloy to provide a solidified body, said molten aluminum base alloy being solidified at a rate between liquidus and solidus temperatures of the aluminum base alloy in a range of 5° to 100° C./sec. to provide an entire solidified body having a dendritic microstructure having a grain size in the range of 20 to 250 μm and a dendritic arm spacing of 2 to 50 μm;

(c) thereafter, applying heat by inductively heating said solidified body to bring said solidified body to a superheated temperature of 3° to 50° C. above said solidus temperature of said aluminum base alloy, said heating to said superheated temperature being at a rate in the range of 200° to 1000° C./min;

(d) effecting thermal transformation of said entire body having said dendritic structure to a globular structure contained in a lower melting eutectic when said entire body is uniformly heated to said superheated temperature; and (e) forming said body having said globular structure in a semi-solid condition into said article.

18. The method in accordance with claim 17 wherein said alloy comprises 0.2 to 5 wt. % copper.

19. A process for casting, thermally transforming and semi-solid forming an aluminum base alloy into an article, the process comprising the steps of:

(a) providing a molten body of said aluminum base alloy comprising 2 to 10.6 wt. % magnesium, less than 2.5 wt. % silicon, and 0.02 to 0.15 wt. % titanium, the remainder comprising aluminum, incidental elements and impurities;

(b) casting said molten body of aluminum base alloy to provide a solidified body, said molten aluminum base alloy being solidified at a rate between liquidus and solidus temperatures of the aluminum base alloy in a range of 5° to 100° C./sec to provide an entire solidified body having a dendritic microstructure having a grain size in the range of 20 to 250 μm;

(c) thereafter, heating said solidified body to bring said body to a superheated temperature of 3° to 50° C. above said solidus temperature of said aluminum base alloy while maintaining said body in a solid shape, said heating to said superheated temperature being at a rate greater than 30° C. per minute;

(d) effecting thermal transformation of said entire body having said dendritic structure when said entire body is uniformly heated to said superheated temperature; and (e) forming said body having said globular structure in a semi-solid condition into said article.

20. The method in accordance with claim 19 including maintaining said body at said superheated temperature for a period in the range of 1 to 60 seconds to effect thermal transformation of said entire body to a globular form contained in a lower melting eutectic.

21. The method in accordance with claim 19 including maintaining said body at said superheated temperature for a period in the range of 5 to 40 seconds to effect thermal transformation of said entire body to a globular from contained in a lower melting eutectic.

22. The method in accordance with claim 19 wherein said solidified body having a dendritic structure has a grain size in the range of 20 to 200 μm.

23. The method in accordance with claim 19 including resistively heating said body to a superheated temperature.

24. The method in accordance with claim 19 including inductively heating said solidified body to a superheated temperature.

25. A process for casting, thermally transforming and semi-solid forming an aluminum base alloy into an article, the process comprising the steps of:

(a) providing a molten body of said aluminum base alloy comprising 0.2 to 2.4 wt. % magnesium, 2 to 8 wt. % zinc, the remainder aluminum, incidental elements and impurities;

(b) casting said molten body of aluminum base alloy to provide a solidified body, said molten aluminum base alloy being solidified at a rate between liquidus and solidus temperatures of the aluminum base alloy in a range of 5° to 100° C./sec. to provide an entire solidified body having a dendritic microstructure;

(c) thereafter, heating said solidified body to bring said body to a superheated temperature of 3° to 50° C. above said solidus temperature of said aluminum base alloy while maintaining said body in a solid shape, said heating to said superheated temperature being at a rate greater than 30° C. per minute;

(d) effecting thermal transformation of said entire body having said dendritic structure when said entire body is uniformly heated to said superheated temperature; and (e) forming said body having said non-dendritic structure in a semi-solid condition into said article.

26. The method in accordance with claim 25 including maintaining said body at said superheated temperature for a period in the range of 1 to 60 seconds to effect thermal transformation of said entire body to a globular form contained in a lower melting eutectic.

27. The method in accordance with claim 25 including maintaining said body at said superheated temperature for a period in the range of 5 to 40 seconds to effect thermal transformation of said entire body to a globular from contained in a lower melting eutectic.

28. The method in accordance with claim 25 wherein said solidified body having a dendritic structure has a grain size in the range of 20 to 200 μm.

29. The method in accordance with claim 25 including resistively heating said body to a superheated temperature.

30. The method in accordance with claim 25 including inductively heating said solidified body to a superheated temperature.

31. A process for casting, thermally transforming and semi-solid forming an aluminum base alloy into an article, the process comprising the steps of:

(a) providing a molten body of said aluminum base alloy comprising 6.5 to 7.5 wt. % silicon, 0.25 to 0.45 wt. % magnesium, less than 0.15 wt. % titanium, the remainder aluminum, incidental elements and impurities;

(b) casting said molten body of aluminum base alloy to provide a solidified body, said molten aluminum base alloy being solidified at a rate between liquidus and solidus temperatures of the aluminum base alloy in a range of 5° to 100° C./sec to provide an entire solidified body having a dendritic microstructure having a grain size in the range of 20 to 250 μm;

(c) thereafter, heating said solidified body to bring said body to a superheated temperature of 3° to 50° C. above said solidus temperature of said aluminum base alloy while maintaining said body in a solid shape, said heating to said superheated temperature being at a rate greater than 30° C. per minute;

(d) effecting thermal transformation of said entire body having said dendritic structure when said entire body is uniformly heated to said superheated temperature; and (e) forming said body having said non-dendritic structure in a semi-solid condition into said article.

32. A process for casting, thermally transforming and semi-solid forming an aluminum base alloy to provide an article substantially free of porosity, the process comprising the steps of:

(a) providing a molten body of said aluminum base alloy;

(b) casting said molten body of aluminum base alloy to provide a solidified body, said molten aluminum base alloy being solidified at a rate between liquidus and solidus temperatures of the aluminum base alloy in a range of 5° to 100° C./sec. to provide a solidified body having a dendritic microstructure;

(c) homogenizing said solidified body;

(d) thereafter, applying heat to said solidified body to bring said body to a superheated temperature of 3° to 50° C. above said solidus temperature of said aluminum base alloy while maintaining said body in a solid shape;

(e) effecting thermal transformation of said body having said dendritic structure when said body is uniformly heated to said superheated temperature; and (f) forming said body having said non-dendritic structure in a semi-solid condition into said article substantially free of porosity.

33. The process in accordance with claim 32 wherein said solidified body is homogenized at a temperature in the range of 482° to 593° C.

34. The method in accordance with claim 32 including heating said body to said superheated temperature at a rate greater than 30° C. per minute.

35. The method in accordance with claim 32 including heating said body at a rate of greater than 45° C. per minute.

36. The method in accordance with claim 32 including heating said body to said superheated temperature at a rate in the range of 30° to 1000° C./min.

37. The method in accordance with claim 32 including maintaining said body at said superheated temperature for a period in the range of about 1 second to 60 seconds.

38. The method in accordance with claim 32 including maintaining said body at said superheated temperature for a period in the range of about 5 to 40 seconds.

39. The method in accordance with claim 32 wherein said solidified body having a dendritic structure has a grain size in the range of 20 to 250 μm.

40. The method in accordance with claim 32 wherein said dendritic structure is thermally transformed to a globular structure dispersed in a lower melting eutectic phase.

41. The method in accordance with claim 32 wherein said aluminum base alloy comprises 2.5 to 11 wt. % silicon.

42. The method in accordance with claim 32 wherein said aluminum base alloy comprises 5 to 7.5 wt. % silicon.

43. The method in accordance with claim 32 wherein said aluminum base alloy comprises 0.2 to 2.0 wt. % magnesium.

44. The method in accordance with claim 32 wherein said aluminum base alloy comprises 0.01 to 0.2 wt. % titanium.

45. The method in accordance with claim 32 wherein said aluminum base alloy comprises 0.02 to 0.15 wt. % titanium.

46. The method in accordance with claim 32 wherein said aluminum base alloy comprises less than 0.1 wt. % titanium.

47. The method in accordance with claim 32 wherein said aluminum base alloy comprises 2 to 11 wt. % silicon, 0.2 to 0.7 wt. % magnesium and 0.02 to 0.15 wt. % titanium.

48. The method in accordance with claim 32 including resistively heating said body to a superheated temperature.

49. The method in accordance with claim 32 including inductively heating said solidified body to a superheated temperature.

50. The method in accordance with claim 32 wherein said alloy comprises 0.2 to 5 wt. % copper.

51. A process for casting, thermally transforming and semi-solid forming an aluminum base alloy into an article, the process comprising the steps of:

(a) providing a molten body of said aluminum base alloy comprising 4 to 9 wt. % silicon, 0.2 to 2.0 wt. % magnesium, and 0.02 to 0.15 wt. % titanium, balance aluminum and incidental elements and impurities;

(b) casting said molten body of aluminum base alloy to provide a solidified body, said molten aluminum base alloy being solidified at a rate between liquidus and solidus temperatures of the aluminum base alloy in a range of 5° to 100° C./sec. to provide an entire solidified body having a dendritic microstructure having a grain size in the range of 20 to 250 μm and a dendritic arm spacing of 2 to 50 μm;

(c) thereafter, applying heat by inductively heating said solidified body to bring said solidified body to a superheated temperature of 3° to 50° C. above said solidus temperature of said aluminum base alloy, said rate of heating to said superheated temperature being at a rate in the range of 200° to 1000° C./min;

(d) effecting thermal transformation of said entire body having said dendritic structure to a globular structure contained in a lower melting eutectic when said entire body is uniformly heated to said superheated temperature;

(e) maintaining said aluminum base alloy body between said solidus temperature and said superheated temperature for a time sufficient to effect thermal transformation of the dendritic microstructure to provide a body having a globular structure contained in a lower melting liquid phase; and (f) forming said body having said globular structure in a semi-solid condition into said article.

52. The method in accordance with claim 51 wherein said alloy comprises 0.2 to 5 wt. % copper.

53. In a method of semi-solid forming shaped aluminum alloy articles wherein the aluminum alloy is provided as a billet, the improvement wherein said billet is provided in an aluminum base alloy comprising 2 to 11 wt. % silicon, 0.2 to 0.7 wt. % magnesium, 0.01 to 0.15 wt. % titanium, the balance aluminum, incidental elements and impurities, said shaped article further being provided in the condition resulting from:

(a) casing said molten body of aluminum base alloy to provide a solidified body, said molten aluminum base alloy being solidified at a rate between liquidus and solidus temperatures of the aluminum base alloy to provide a solidified body having a dendritic grain microstructure having a grain size in the range of 20 to 250 μm;

(b) thereafter, heating said solidified body to bring said body to a superheated temperature of 3° to 50° C. above said solidus temperature of said aluminum base alloy, said heating to said superheated temperature being at a rate greater than 30° per minute;

(c) effecting thermal transformation of said dendritic structure to a non-dendritic structure when said body is uniformly heated to said superheated temperature; and (d) forming said body having said non-dendritic structure in a semi-solid condition into said article.

54. The method in accordance with claim 53 including maintaining said body at said superheated temperature for a period in the range of 1 to 60 seconds.

55. In a method of semi-solid forming shaped aluminum alloy articles wherein the aluminum alloy is provided as a billet, the improvement wherein said billet is provided in an aluminum base alloy comprising 2 to 11 wt. % silicon, 0.2 to 0.7 wt. % magnesium, 0.01 to 0.15 wt. % titanium, the balance aluminum, incidental elements and impurities, said shaped article further being provided in the condition resulting from:

(a) casting said molten body of aluminum base alloy to provide a solidified body, said molten aluminum base alloy being solidified at a rate between liquidus and solidus temperatures of the aluminum base alloy in a range of 5° to 100° C./sec to provide a solidified body having a dendritic microstructure having a grain size in the range of 20 to 200 μm;

(b) thereafter, inductively heating said solidified body to a superheated temperature of 3° to 50° C. above said solidus temperature of said aluminum base alloy, said rate of heating to said superheated temperature being at a rate in the range of 200° to 1000° C./min;

(c) maintaining said body at said superheated temperature for a period in the range of 1 to 60 seconds and effecting thermal transformation of said dendritic microstructure to said globular form in said body; and (d) forming said body having said globular structure in a semi-solid condition into said article.

56. The method in accordance with claim 53 including maintaining said body at said superheated temperature for a period in the range of 1 to 30 seconds.

57. In a method of semi-solid forming shaped aluminum alloy articles wherein the aluminum alloy is provided as a billet, the improvement wherein said billet is provided in an aluminum base alloy comprising 2 to 10.6 wt. % magnesium, less than 2.5 wt. % silicon, and 0.02 to 0.15 wt. % titanium, the remainder comprising aluminum, incidental elements and impurities, said shaped article further being provided in the condition resulting from:

(a) casting said molten body of aluminum base alloy to provide a solidified body, said molten aluminum base alloy being solidified at a rate between liquidus and solidus temperatures of the aluminum base alloy in a range of 5° to 100° C./sec to provide a solidified body having a dendritic microstructure having a grain size in the range of 20 to 250 μm;

(b) thereafter, heating said solidified body to bring said body to a superheated temperature of 3° to 50° C. above said solidus temperature of said aluminum base alloy, said heating to said superheated temperature being at a rate greater than 30° C. per minute;

(c) effecting thermal transformation of said dendritic structure to a non-dendritic structure when said body is uniformly heated to said superheated temperature; and (d) forming said body having said globular structure in a semi-solid condition into said article.

58. The method in accordance with claim 36 including maintaining said body at said superheated temperature for a period in the range of 1 to 60 seconds.

* * * * *